US008079771B2

(12) United States Patent
Ko

(10) Patent No.: US 8,079,771 B2
(45) Date of Patent: Dec. 20, 2011

(54) SPRAY BRUSH

(76) Inventor: Chuan-Wei Ko, Chung-Li (TW)

( * ) Notice: Subject to any disclaimer, the term of this patent is extended or adjusted under 35 U.S.C. 154(b) by 373 days.

(21) Appl. No.: 12/511,070

(22) Filed: Jul. 29, 2009

(65) Prior Publication Data

US 2011/0027004 A1 Feb. 3, 2011

(51) Int. Cl.
*A46B 11/02* (2006.01)
*B43K 5/02* (2006.01)

(52) U.S. Cl. ..... 401/188 R; 401/185

(58) Field of Classification Search ..... 401/183–185, 401/188 R, 276, 286
See application file for complete search history.

(56) References Cited

U.S. PATENT DOCUMENTS 4,429,434 A * 2/1984 Sung-shan ..... 401/183
6,142,695 A * 11/2000 Byun ..... 401/188 R
6,533,482 B1 * 3/2003 Byun ..... 401/188 R
6,935,802 B1 * 8/2005 Byun ..... 401/188 R

* cited by examiner

*Primary Examiner* — Tuan Nguyen

(57) ABSTRACT

A direction-free spray brush includes an applicator body, which defines an accommodation chamber and holds a brush at the front side and a spray tube in the brush, an accumulation tube connected to the spray tube and having an accumulation chamber and a side hole in communication between the accumulation chamber and the accommodation chamber for guiding a powder substance from the accommodation chamber into the accumulation chamber, and an air inflator, which has an air guide connected to the accumulation chamber of the accumulation tube and an inflation bulb fastened to the air guide for pumping air through the air passage in the air guide into the accumulation chamber to force the powder substance from the accumulation chamber through the spray tube into the brush for application.

4 Claims, 5 Drawing Sheets

SPRAY BRUSH

BACKGROUND OF THE INVENTION

1. Field of the Invention

The present invention relates to a powder substance applicator implement and more particularly, to a spray brush, which enables a powder substance to be evenly distributed in a brush for application without any directional limitation.

2. Description of the Related Art

For applying a powder cosmetic, bath powder, baby powder or any of a variety of powder substances to the skin of a person, a spray brush may be used. However, when using a spray brush to pick up a powder substance for application, the powder substance is not evenly distributed in the brush for application.

There is known a spray brush for applying a powder substance to the skin of a person. According to this design, the spray brush comprises a brush holder that defines an accommodation chamber for accommodating a powder substance and a plurality of fine through holes, a brush fastened to one side of the brush holder over the fine through holes, and an inflation bulb fastened to the brush holder and compressible to force air into the accommodation chamber for forcing the powder substance from the accommodation chamber through the fine through holes into the brush for application. This design of spray brush is still not satisfactory in function and has drawbacks as follows:

(a) When a user carries the spray brush, the powder substance may leak out of the fine holes, causing waste and contamination.

(b) When using the spray brush, the brush must be held downwards. If the brush is held upwards, forced air will go through the fine holes directly without carrying the powder substance. This directional limitation causes great inconvenience to the user.

SUMMARY OF THE INVENTION

The present invention has been accomplished under the circumstances in view. It is one object of the present invention to provide a spray brush, which enables a storage powder substance to be evenly distributed in the brush thereof by forced air before application. It is another object of the present invention to provide a spray brush, which is convenient for use without any directional limitation.

To achieve these and other objects of the present invention, a spray brush comprises an applicator body, which defines an accommodation chamber and holds a brush at the front side and a spray tube in the brush, an accumulation tube connected to the spray tube and having an accumulation chamber and a side hole in communication between the accumulation chamber and the accommodation chamber for guiding a powder substance from the accommodation chamber into the accumulation chamber, and an air inflator, which has an air guide connected to the accumulation chamber of the accumulation tube and an inflation bulb fastened to the air guide for pumping air through the air passage in the air guide into the accumulation chamber to force the powder substance from the accumulation chamber through the spray tube into the brush for application.

DETAILED DESCRIPTION OF THE PREFERRED EMBODIMENT

Figure 1:
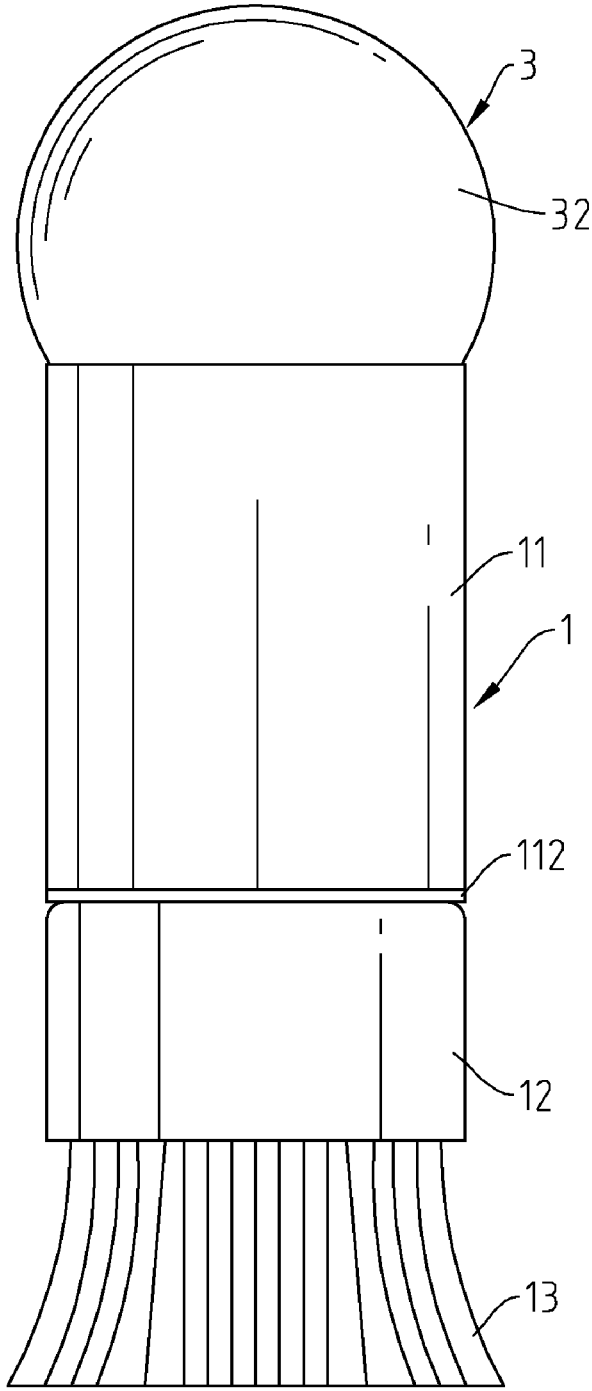
FIG. 1 is a side view of a spray brush in accordance with the present invention/
Figure 2:
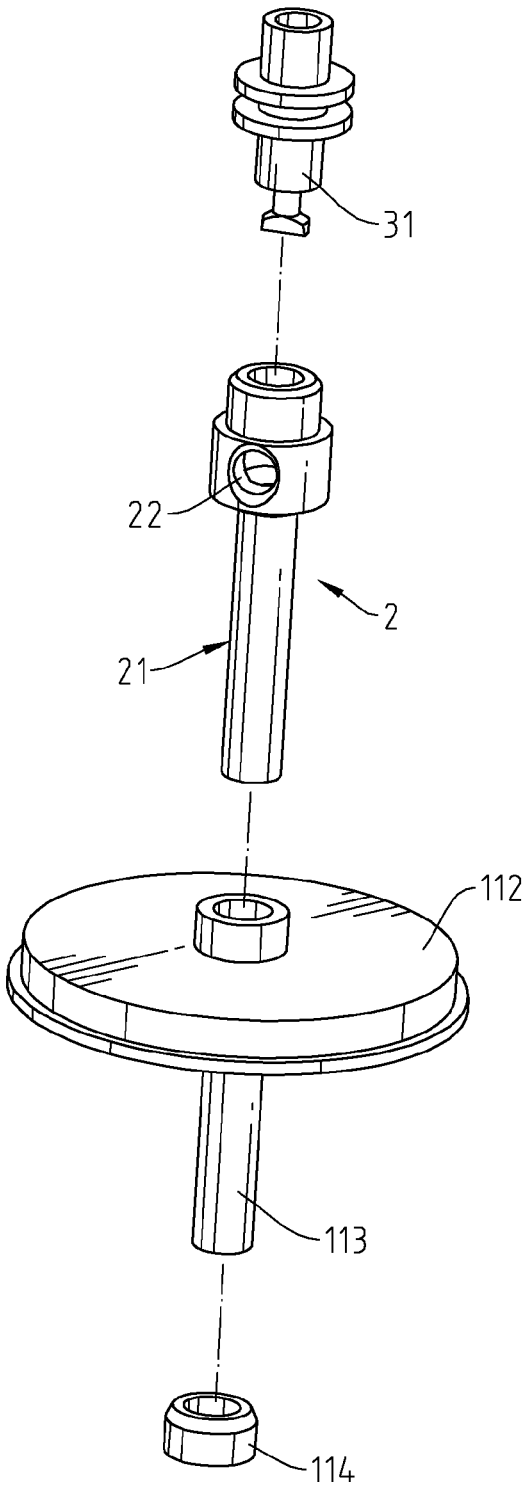
FIG. 2 is an exploded view of a part of the spray brush in accordance with the present invention.
Figure 3:
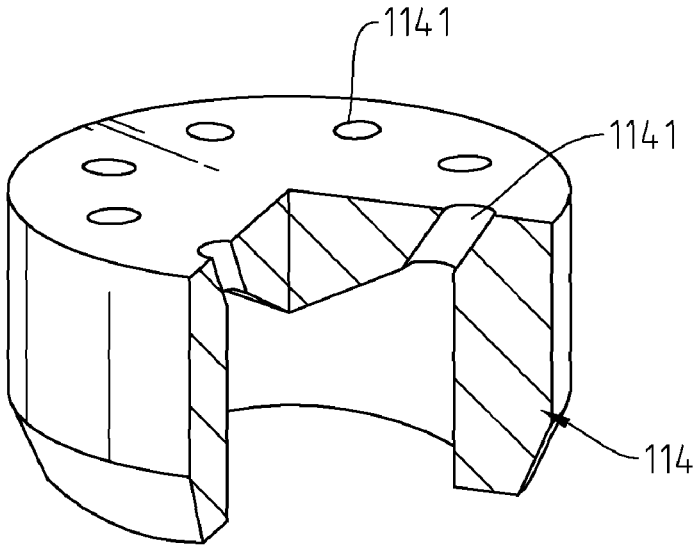
FIG. 3 is a sectional elevation of the nozzle head according to the present invention.
Figure 4:
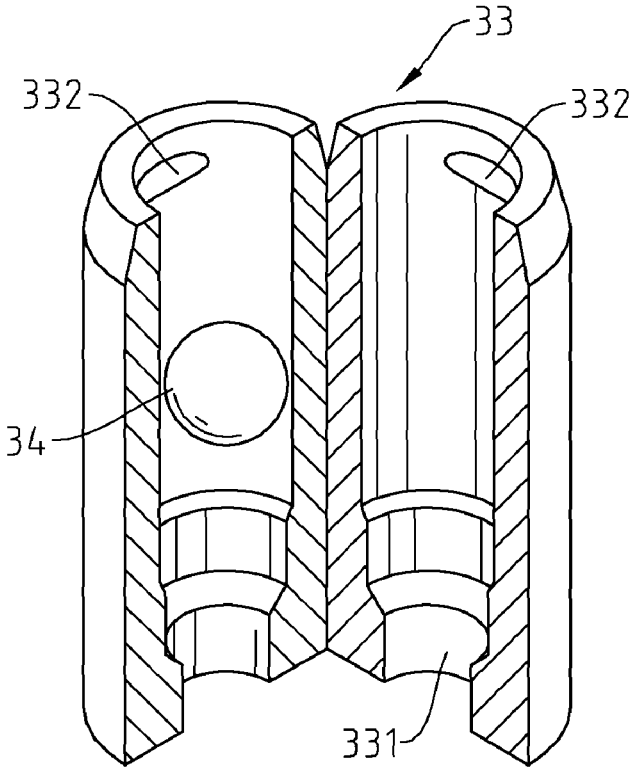
FIG. 4 is an extended out view of the check valve according to the present invention.

Referring to FIGS. 1~4, a powder substance spray brush in accordance with the present invention is shown comprising an applicator body 1, an accumulation tube 2 and an air inflator 3.

The applicator body 1 comprises a first housing 11 defining therein an accommodation chamber 111, a cover 112 covering one side of the accommodation chamber 111, a second housing 112 fastened to the first housing 11 and abutted against the cover 112, a spray tube 113 perpendicularly extended from the center of the cover 112 into the inside of the second housing 112, a nozzle head 114 capped on the end of the spray tube 113 and having radially arranged jet holes 1141, and a brush 13 fastened to the second housing 12 and extended out of one side of the second housing 12 opposite to the first housing 11.

The accumulation tube 2 is mounted inside the applicator body 1, comprising a tube body 21 suspending in the accommodation chamber 111 and connected to the spray tube 113 at the cover 112, an accumulation chamber 211 defined in one end of the tube body 21, and a side hole 22 in air communication between the accumulation chamber 211 and the accommodation chamber 111.

The air inflator 3 comprises an air guide 31 fixedly fastened to the other side of the first housing 11 opposite to the second housing 12 and connected to the accumulation chamber 211 in one end of the tube body 21 remote from the spray tube 113, an inflation bulb 32 fastened to one end of the air guide 31 remote from the spray tube 113 for pumping air through an air passage 311 defined in the air guide 31 into the accumulation chamber 211, and a check valve 33 mounted in the air passage 311 near the inflation bulb 32 and holding a valve ball 34. The check valve 33 has inside stop flanges 332 near its one end in proximity to the air guide 31 and a reducing portion 331 at its other end. Further, the inflation bulb 32 has an air intake flap 321 for letting air.

Figure 5:
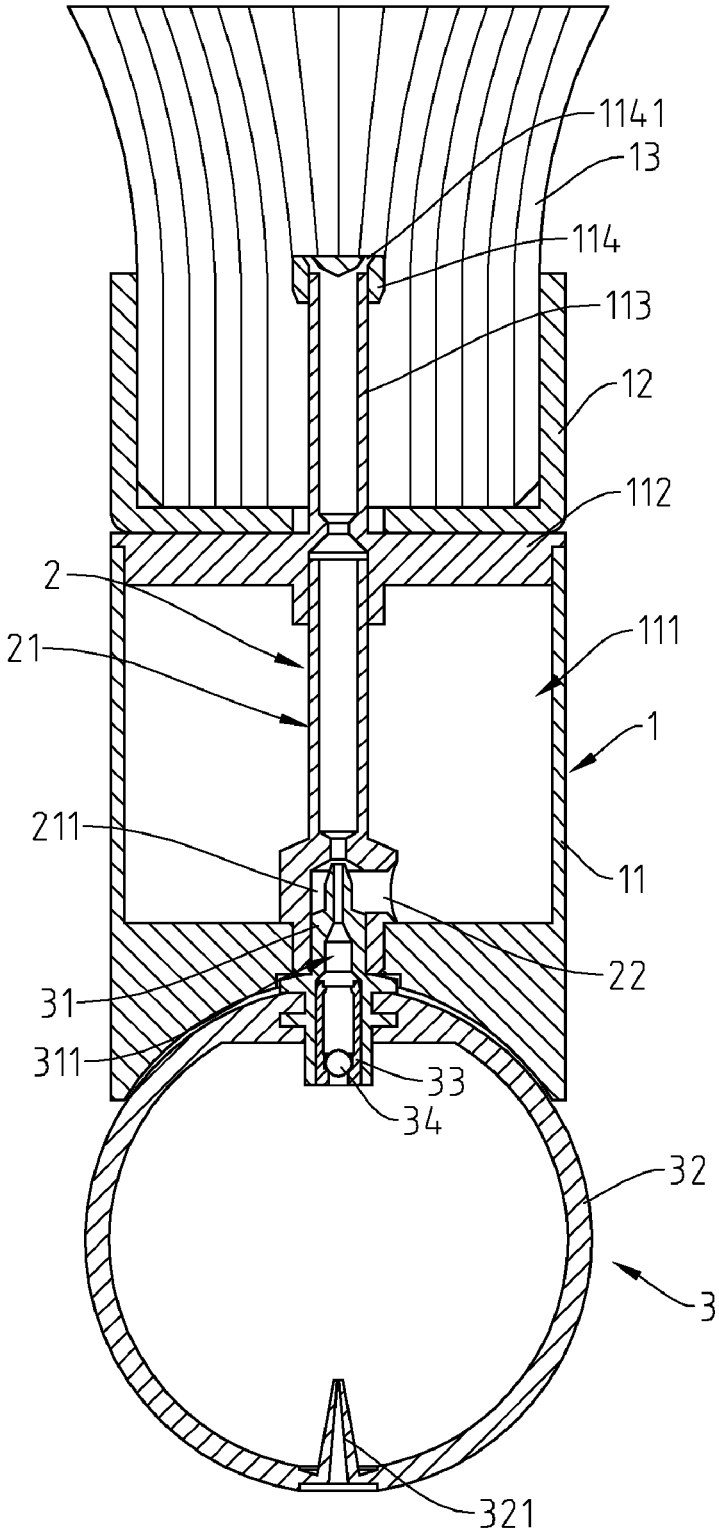
FIG. 5 is a sectional side view of the spray brush according to the present invention.
Figure 6:
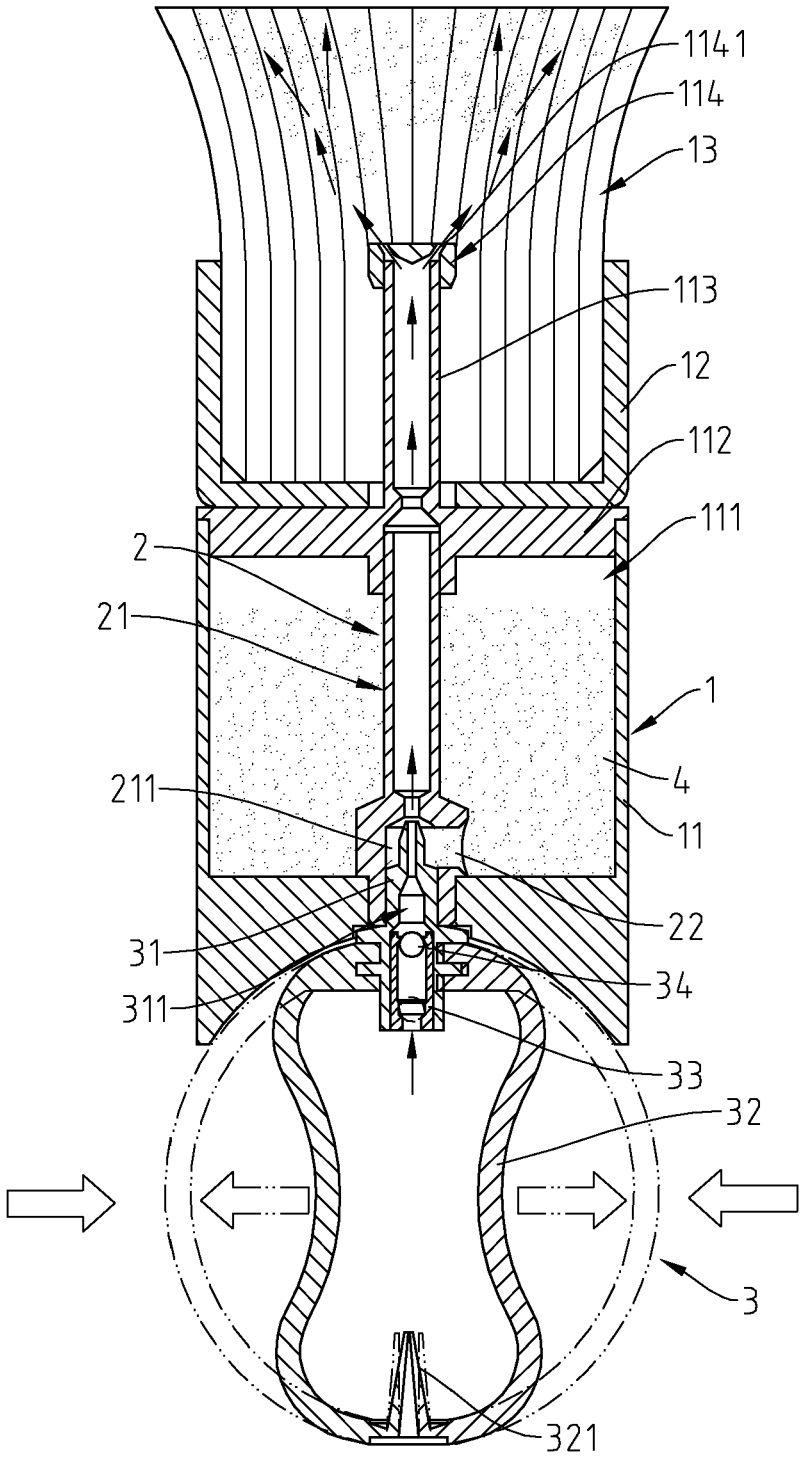
FIG. 6 corresponds to FIG. 5, showing the inflation bulb compressed and the powder substance forced out of the nozzle head into the brush.

Referring to FIGS. 5 and 6, before using the spray brush, unfasten the second housing 12 from the first housing 11 and open the cover 112, and then fill a powder substance 4 in the accommodation chamber 111. After filling of the powder substance 4 in the accommodation chamber 111, close the cover 112 and then fasten the second housing 12 to the first housing 11. At this time, a part of the powder substance 4 goes through the side hole 22 of the tube body 21 into the accumulation chamber 211. When the user squeezes the inflation bulb 32, the inside air is compressed and forced through the air passage 311 of the air guide 31 into the accumulation chamber 211 to force the accumulated powder substance 4 out of the accumulation chamber 211 through the spray tube 113 to the outside of the nozzle head 114 via the jet holes 1141. When the powder substance 4 is forced out of the jet holes 1141, it is evenly distributed in the brush 13 for application to a predetermined skin surface area of the skin of a person. Because the invention uses the side hole 22 to guide the powder substance 4 into the accumulation chamber 211, the spray brush can be manipulated to force the powder substance 4 out of the nozzle head 114 into the brush 13 at any desired angle without limitation.

Further, when the user squeezes the inflation bulb 32 to force inside air into the air passage 311 of the air guide 31, the valve ball 34 is forced by the compressed air to move to the inside stop flanges 332 for enabling the compressed air to pass to the inside of the accumulation chamber 221 and to further force the powder substance 4 out of the accumulation chamber 221 through the spray tube 113 to the outside of the nozzle head 114 via the jet holes 1141. When the user releases the pressure from the inflation bulb 32, the air intake flap 321 is opened for letting air enter the inside space of the inflation bulb 32 so that the inflation bulb 32 immediately returns to its former shape subject to its elastic material property, and at the same time the valve ball 34 moves to the reducing portion 331 to block the air passage 311 of the air guide 31, avoiding back flow of air from the accumulation chamber 211 into the inside of the inflation bulb 32.

A prototype of spray brush has been constructed with the features of FIGS. 1~6. The spray brush functions smoothly to provide all of the features disclosed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A spray brush, comprising:

an applicator body, said applicator body comprising an accommodation chamber that accommodates a powder substance, a brush located on one side of said applicator body, and a spray tube extended suspending in said brush;

an accumulation tube mounted inside said applicator body and connected to one end of said spray tube remote from said brush, said accumulation tube having an accumulation chamber defined in one end thereof remote from said spray tube and a side hole in communication between said accumulation chamber and said accommodation chamber; and an air inflator, said air inflator comprising an air guide fixedly fastened to said applicator body and connected to said accumulation chamber of said accumulation tube, said air guide defining therethrough an air passage, and an inflation bulb fastened to one end of said air guide outside said applicator body for pumping air through the air passage in said air guide into said accumulation chamber to force said powder substance from said accumulation chamber through said spray tube into said brush.

2. The spray brush as claimed in claim 1, wherein said applicator body further comprises a first housing having said accommodation chamber defined therein, a cover capped on one side of said first housing and holding said spray tube in said brush, and a second housing fastened to said first housing and abutted against said cover and holding said brush around said spray tube.

3. The spray brush as claimed in claim 1, wherein said spray tube has a nozzle head attached to one end thereof and suspending in said brush, said nozzle head having a plurality of radial jet holes for guiding said powder substance out of said spray tube.

4. The spray brush as claimed in claim 1, wherein said air inflator further comprises a check valve mounted in said air passage of said air guide near said inflation bulb, said check valve having at least one inside stop flange at one end thereof and a reducing portion at an opposite end thereof, and a valve ball moving in said check valve between said at least one inside stop flange and said reducing portion to close/open said check valve; said inflation bulb has an air intake flap disposed remote from said air guide for letting outside atmospheric air enter said inflation bulb and prohibiting inside air from escaping out of said inflation bulb.

* * * * *